US006068342A

United States Patent [19]

Mariani et al.

[11] Patent Number: 6,068,342

[45] Date of Patent: May 30, 2000

[54] RECREATIONAL FURNITURE CONTAINING MODIFIED HEAD PORTION

[76] Inventors: Renato P. Mariani, 41 December Dr., Dunmore, Pa. 18512; Michael L. Serafini, 107 Fairway Dr., Clarks Summit, Pa. 18411; Leo R. DelSerra, 731 Second St., West Pittston, Pa. 19643; Paul E. Hummel, 1510 Clearview St., Scranton, Pa. 18508

[21] Appl. No.: 09/241,733

[22] Filed: Feb. 2, 1999

Related U.S. Application Data

[60] Provisional application No. 60/073,382, Feb. 2, 1998.

[51] Int. Cl.[7] ..... A47C 17/66

[52] U.S. Cl. ..... 297/900; 297/219.1; 297/284.5; 297/217.6; 297/188.01; 297/188.04; 297/188.08; 5/618; 5/638; 5/905

[58] Field of Search ..... 297/900, 219.1, 297/217.6, 284.5, 188.01, 188.04, 188.06, 188.08, 188.2, 188.21; 5/618, 638, 905

[56] References Cited

U.S. PATENT DOCUMENTS

| | | | |
|---|---|---|---|
| D. 352,635 | 11/1994 | Yoder | 297/900 X |
| 3,828,377 | 8/1974 | Fary, Sr. . | |
| 3,897,102 | 7/1975 | Lemaire | 297/900 X |
| 4,072,341 | 2/1978 | Kurz . | |
| 4,108,492 | 8/1978 | Kirby | 297/284.6 X |
| 4,606,086 | 8/1986 | Rowland | 297/900 X |
| 4,614,377 | 9/1986 | Luo | 297/19 |
| 4,633,536 | 1/1987 | Tribble-DuBose . | |
| 4,779,297 | 10/1988 | Sturges | 5/638 X |
| 4,876,755 | 10/1989 | Parrish | 297/284.5 X |
| 4,890,882 | 1/1990 | Harrington | 297/45 |
| 4,891,854 | 1/1990 | Finkelstein | 297/900 X |
| 4,941,222 | 7/1990 | Prager | 297/900 X |
| 5,121,969 | 6/1992 | Schroeder | 297/900 X |
| 5,177,823 | 1/1993 | Riach | 5/638 X |
| 5,222,779 | 6/1993 | Johnson | 297/900 X |
| 5,237,713 | 8/1993 | Prager | 297/900 X |
| 5,297,850 | 3/1994 | Guleserian | 297/900 X |
| 5,466,039 | 11/1995 | Umbrianna | 297/900 X |
| 5,624,157 | 4/1997 | Kostuk | 297/900 X |
| 5,632,050 | 5/1997 | Zajas et al. | 5/638 X |
| 5,661,860 | 9/1997 | Heitz | 5/638 |
| 5,675,851 | 10/1997 | Feathers | 5/638 X |
| 5,829,080 | 11/1998 | Robillard et al. | 297/900 X |
| 5,926,871 | 7/1999 | Howard | 297/900 X |
| 5,946,749 | 9/1999 | Sewell | 297/900 X |
| 5,947,561 | 9/1999 | Ryan | 297/900 X |

FOREIGN PATENT DOCUMENTS

| | | |
|---|---|---|
| 2501986 | 3/1981 | France . |
| 19511816 | 3/1995 | Germany . |

*Primary Examiner*—Peter M. Cuomo
*Assistant Examiner*—Rodney B. White
*Attorney, Agent, or Firm*—Baker Botts, L.L.P.

[57] ABSTRACT

Furniture for recreation and relaxation such as chairs that are lightweight, collapsible, and portable is disclosed. Chairs may have a plurality of sections at least one of which is a head section. The head section comprises a cavity that is substantially oval, with a surrounding mount which is attached to the head section of the chair. A moldable cushion having a cover envelopes the mount such that the head of a reclining individual may be placed on the cushion. The cavity is at least the size to allow the reclining individual to view through the cavity and perform tasks such as reading. The cover may be removable from the cushion. The head of the reclining individual rests on the cushion while viewing through the cavity. The cushion surrounds the mount and cavity to provide structure to the cover and conform to the features of the head of the reclining individual. The head section may be pivotally attached to other sections of the chair.

19 Claims, 2 Drawing Sheets

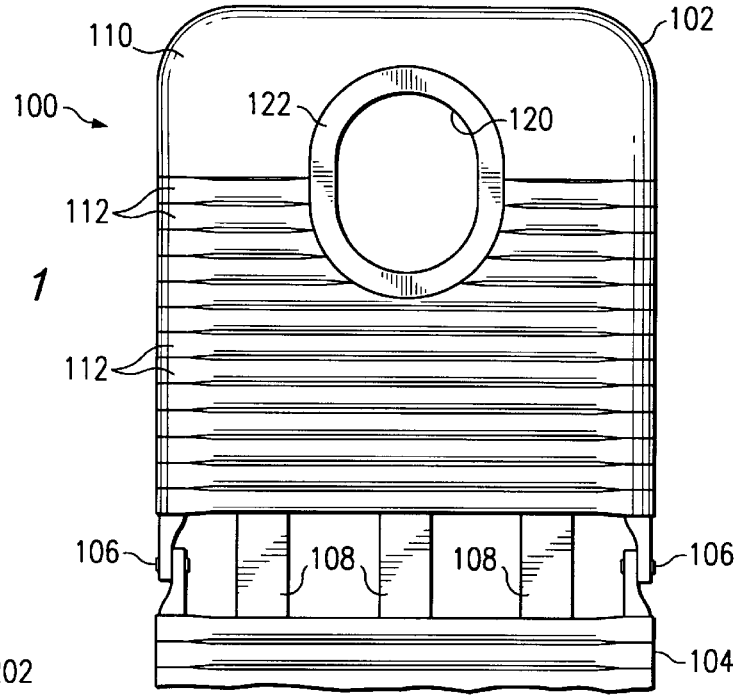
FIG. 1
FIG. 2
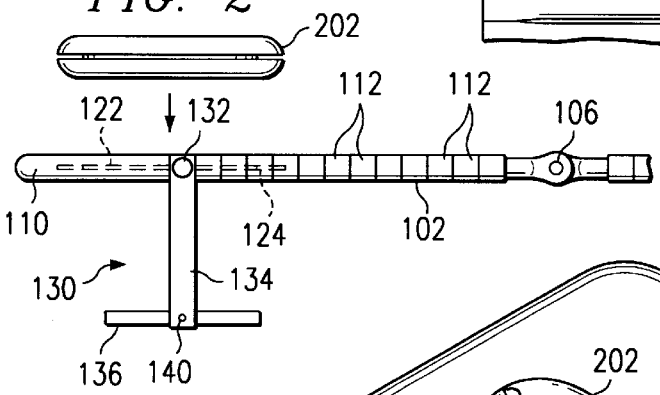
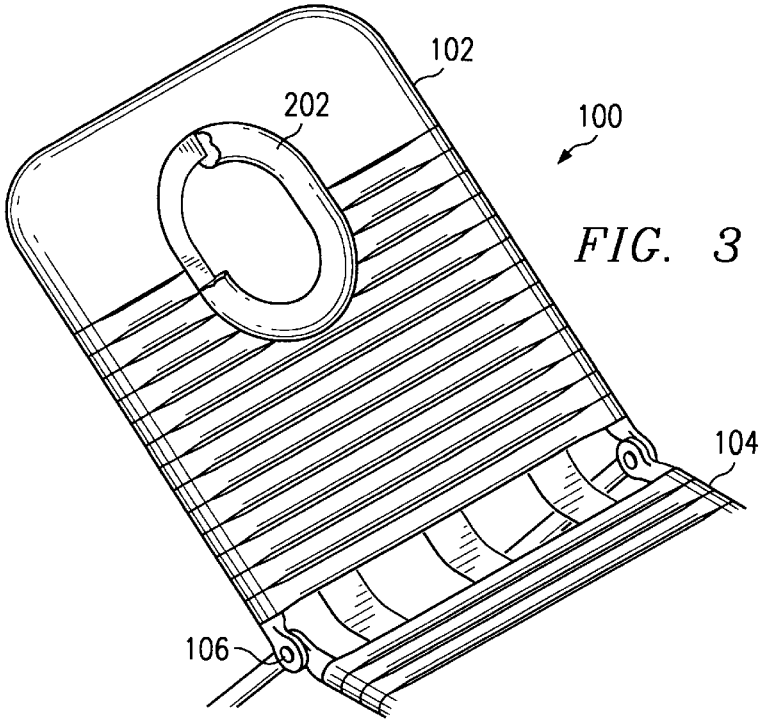
FIG. 3

RECREATIONAL FURNITURE CONTAINING MODIFIED HEAD PORTION

This application claims priority, under 35 U.S.C. § 119(e)(1), based upon provisional application 60/073,382, filed Feb. 2, 1998.

BACKGROUND OF THE INVENTION

1. Field of the Invention

The present invention relates to household furniture and especially reclining furniture used for relaxation and recreation containing a modified head portion.

2. Description of the Background

Chairs such as reclining chairs come in a large variety of shapes and sizes. Generally, chairs are shaped to accommodate a person and have a desired utility. Types of chairs include beach chairs, kitchen chairs, recliners, lawn chairs and many others. Supports or arms may be included on a chair to make the individual more comfortable. Chairs also may be adjustable to allow the chair to conform to different body shapes, as described in U.S. Pat. No. 4,072,341. Some chairs may have head rests, or sections to accommodate a person's upper body. In particular, a head rest may be on a chair such that one can lie their head on the chair without discomfort. These head rests are generally only for a person lying in the face-up position.

One type of chair is a foldable lawn chair that allows one to collapse and transport the chair after use, as described in U.S. Pat. No. 4,890,882. These chairs are generally portable and convenient for outside activities. Another type of chair is a lounge chair, as described in U.S. Pat. No. 4,614,377, which is generally used outdoors. These chairs can be manipulated to recline in a variety of positions. One can lie down on the chairs while sunbathing or reading. These chairs may have, but are not limited to, a configuration where the chair has three sections, with the middle section remaining fixed and the two outer sections moving in a circular motion wherein the outer sections are connected pivotally to each end of the middle section. The two outer sections may be positioned at angles determined by the person using the chair. One outer section may be formed for the upper body, such as head and shoulders, while the other section may be formed to accommodate one's lower body, such as the legs. However, in many such chairs, the upper and lower body sections are interchangeable.

A problem with these chairs is that the sections tend to be flat and do not support particular body parts, such as the head, while reclining. Lying face-down requires one to raise themselves on their elbows or to use uncomfortable methods to perform acts such as reading. Lying in the face-up position, due to body ergonomics, typically requires the individual to turn their head to more fully relax. This may be of concern when tanning or for persons with neck injuries. Further, no support exists for legs or feet in these chairs.

SUMMARY OF THE INVENTION

The present invention overcomes the problems and disadvantages associated with current strategies and designs and provides recreational furniture with greater utility than is conventionally available.

One embodiment of the invention is directed to a chair comprising a plurality of sections at least one of which is a head section. The head section contains a modified portion which comprises a cavity that allows for a reclining individual to view objects on the opposite side of the chair. The cavity is substantially oval in shape and through the head section. A facial support device is attached to the head section and located in the cavity. The facial support device comprises a mount attaching the facial support device to the head section and a moldable cushion surrounding and attached to the mount. Thus, the face of a reclining individual is placed into the facial support device and through the head section. A cover may envelope the moldable cushion to provide added comfort. The facial support device may be detachable from the head section.

Another embodiment of the invention is directed to recreational furniture that contains a modified head portion. Recreational furniture includes chairs such as recliners, lawn chairs, beach chairs and the like. The modified head portion comprises a cavity surrounded with a mount. The mount may optionally be covered with a fabric or foam material for cushioning or ease of cleaning.

Another embodiment of the invention is directed to a head member that is attachable to a chair, and provides a modified head section that contains a head-shaped cavity.

The chair of this invention provides a means for allowing one to read or look through the head section of a chair in relative comfort. This permits one to view a book when lying face-down on the chair and provides access to objects through the chair. The invention also provides support for one's face and head when viewing through the cavity. It is an advantage of this invention that the chair may be used by a person lying in the face-down as well as the face-up position.

Other embodiments and advantages of the invention are set forth, in part, in the description which follows and, in part, will be obvious from this description or may be learned from the practice of the invention.

BRIEF DESCRIPTION OF THE DRAWINGS

For a more complete understanding of the present invention and the advantages thereof, reference is now made to the following descriptions taken in connection with the accompanying drawing, in which:

FIG. 1 illustrates a top view of a chair in accordance with an embodiment of the present invention.

FIG. 2 illustrates a side view of a chair in accordance with the present invention.

FIG. 3 illustrates a tilted perspective view of a chair in accordance with the present invention.

DESCRIPTION OF THE INVENTION

Figure 5:
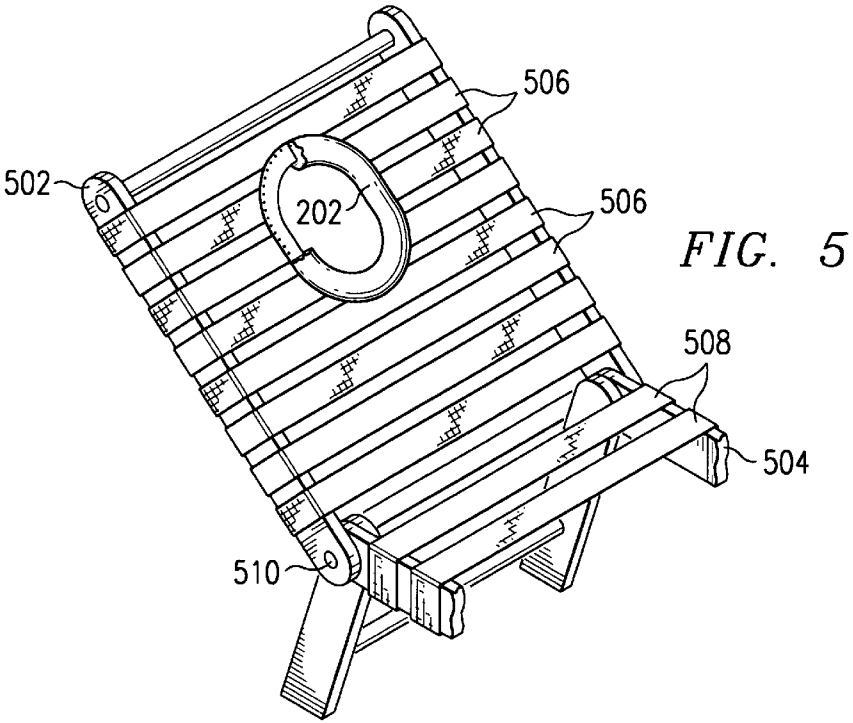
FIG. 5 illustrates a side view of a chair in accordance with another embodiment of the present invention.

Embodiments of the present invention and its advantages are best understood by referring now in more detail to FIGS. 1–5 of the drawing, in which like numerals refer to like parts. As embodied and broadly described herein, the present invention is directed to furniture comprising a head-resting portion containing a cavity.

FIG. 1 depicts a top side view of chair 100 in accordance with the present invention. Chair 100 is for recreational use, and not for use as a medical device. Recreational use may be defined as use in the outdoors, at the beach, or any place where a reclining person relaxes and rests. Further, chair 100 is inexpensive to manufacture, and may be produced in large lots for ease of distribution.

Chair 100 has a head section 102 and a middle section 104. Chair 100 also includes hinges 106 that pivotally attach head section 102 to middle section 104. Head section 102 may be comprised of a frame that has straps 112 wrapped around the frame in a horizontal direction. Straps 112 may be made of vinyl, plastic, fabric or any other material suitable for supporting weight. Head section 102's frame may be comprised aluminum, wood, metal, plastic, or any material suitable for supporting a reclining individual. Preferably, head section 102's frame is comprised of light-weight material to facilitate portability so that chair 100 may be hand carried. Preferably, chair 100 is less than 10 pounds, or 4 kgs., and more preferably 5 pounds, or 2 kgs.

Head section 102 also includes top section 110 enveloping a top section of the aluminum frame of head section 102. Top section 110 also may be comprised of vinyl, plastic, fabric or other material suitable for supporting weight. Head section 102 further includes a cavity 120 that is centrally located in section 102. Cavity 120 also may be off-center or placed along a border area of head section 102. Cavity 120 is designed to accommodate a person's head as one is reclining in chair 100 and may be of variable size. Cavity 120 is substantially oval in shape. Cavity 120 may be of a variety of sizes, such as for a child or an adult head, and may be adjustable. Mount 122 surrounds cavity 120 and provides a border for cavity 120 to head section 102. Mount 122 is attachably mounted to head section 102.

Middle section 104 includes straps in the horizontal direction surrounding a frame, similar to head section 102. Head section 102 is pivotally attached to middle section 104 by hinges 106. Connecting straps 108 also connect head section 102 to middle section 104.

FIG. 2 depicts head section 102 in a horizontal position in accordance with the present invention. Head section 102 is parallel in the horizontal plane with middle section 104. Upper mount 122 is attached to lower mount 124. Upper mount 122 and lower mount 124 are secured to head section 102 or, in the alternative, to each other. Upper mount 122 and lower mount 124 may be secured, for example, by any one or any combination of screws, staples, soldering, glue, pressing, Velcro™, or any other means known to those of ordinary skill in the art. Mounts 122 and 124 may be comprised of, for example, plastic, wood, metal, aluminum, steel, foam, Styrofoam™, cloth, rubber, or any combinations thereof. As described above, mounts 122 and 124 also may be adjustable, such that cavity 120 may be adjusted in size or shape to accommodate the person's head size. Cavity 120 may be adjustable by varying the sizes of mounts 122 and 124 using adjusting means that are well known to those of ordinary skill in the art. Mounts 122 and 124 may be detachable from head section 102. For example, mounts 122 and 124 may be removed for cleaning or storage. Mounts 122 and 124 are detached from head section 102 and pulled out of cavity 120. When mounts 122 and 124 are to be replaced, they may be reattached to head section 102 by pushing mounts 122 ans 124 into cavity 120 and resecuring mounts 122 and 124 to head section 102. Mounts 122 and 124 may also be adjusted while removed to a desired size and then placed back into head section 102.

Cushion 202 is provided to be inserted into cavity 120. Cushion 202 and mounts 122 and 124 comprise a facial support device attached to head section 102. Cushion 202 surrounds and covers mounts 122 and 124 to provide a comfortable support for a person's head as one reclines in chair 100. Cushion 202 may be comprised of moldable support materials such as, for example, cloth, cotton fabric, vinyl, latex, foam, or padding. Cushion 202 also may be a tube inflatable by air, or other gases, and conforms to facial features of a person reclining in chair 100. When cushion 202 is inserted into head portion 102, cushion 202 is aligned such that mounts 122 and 124 are flush with an indented middle section of cushion 202 as depicted in FIG. 2. Cushion 202 overlaps mounts 122 and 124 to come into direct contact with head portion 102. Cushion 202 further may comprise a cover that surrounds cushion 202 and protects cushion 202 from wear and tear. The cover may be comprised of support material such as, for example, cloth, cotton fabric, vinyl, latex or any combination of these materials. The cover may be removable from cushion 202 or, alternatively, may be fastened to cushion 202. Both cushion 202 and the cover may be removable, along with mounts 122 and 124. Further, cushion 202 and the cover may be detached from mounts 122 and 124 for cleaning and other maintenance activities. According to the present invention, cushion 202 rises upward from head section 102. Cushion 202 may rise from only one side of head section 202 or, alternatively, on both sides of head section 102.

Arm 134 is pivotally attached by hinge 132 to head section 102. Hinge 132 allows arm 134 to be variably positioned beneath cavity 120. Thus, arm 134 may be parallel, or flush, with head section 102. Alternatively, as depicted in FIG. 2, arm 134 may be perpendicular to head section 102. Rest 136 may be attached to arm 134 by screw 140. Arm 134 may contain additional funcional characteristics, such as a cavity for use as a cup-holder, or an ashtray. Arm 134 also may have a light attached to one end to illuminate books or magazines resting on arm 134. This allows a person lying on chair 100 with their face against cushion 202 to view objects on rest 136 through cavity 120. According to the present invention, a reclining person may read books or other reading materials while lying face down on chair 100.

FIG. 3 depicts chair 100 at a tilted perspective. Cushion 202 is attached to mounts 122 and 124, and surrounds cavity 120. As described above, head section 102 is pivotally attached to middle section 104 by hinges 106. Head section 102 may be parallel or at an angle to the ground on which chair 100 is placed. Preferably, middle section 104 is parallel to the ground. Hinges 106 allow head section 102 to pivot and be moved at an angle to middle section 104. Further, head section 102 may be adjusted to be flush with middle section 104, such as when transporting chair 100. In an alternative embodiment, hinges 106 are fixed, and head 102 does not rotate and is immovable.

Cushion 202 is placed in cavity 120. A person reclining in chair 100 may view through cavity 120 and rest their head comfortably on cushion 202. Cushion 202 is comprised of moldable material that adjusts to the contours of the facial features of a person looking through cavity 120. One may place their head on cushion 202, such that the head is resting comfortably without the need to turn the head sideways. When lying face up on chair 100, one may rest their head on cushion 202.

Figure 4:
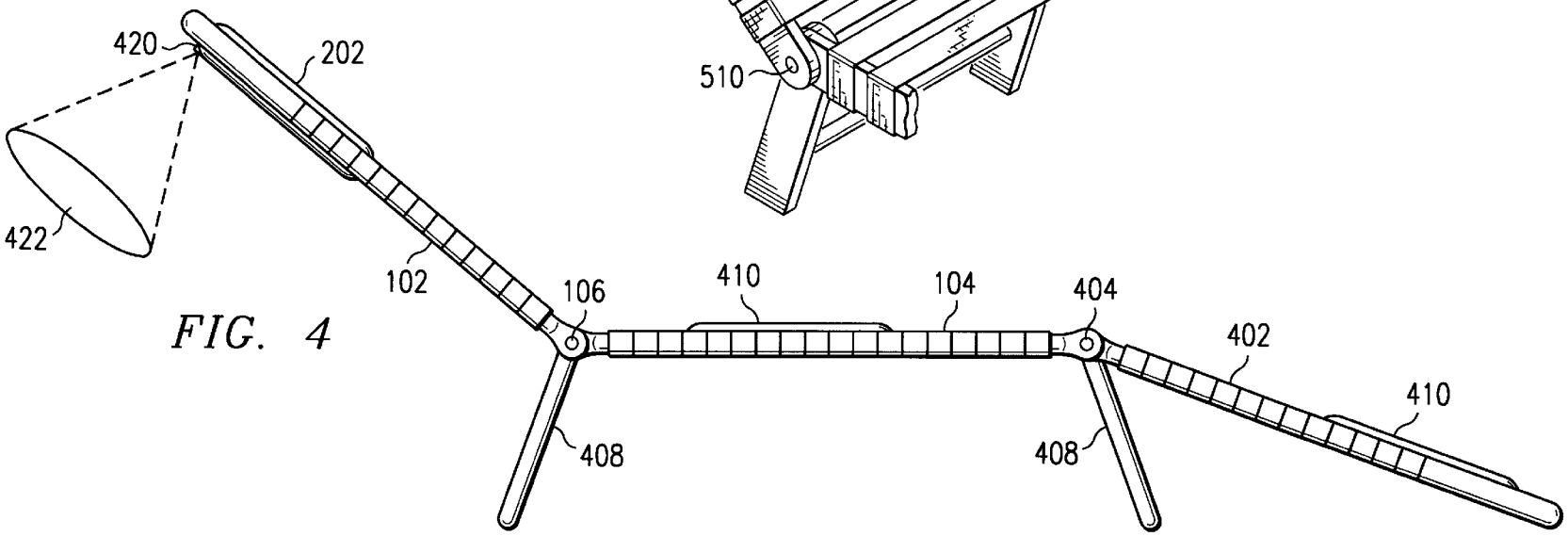
FIG. 4 illustrates a full side view of a chair in accordance with the present invention.

FIG. 4 depicts a full side view of chair 100. In addition to head section 102 and middle section 104, chair 100 includes a foot section 402 pivotally attached by hinge 404 to middle section 104. Foot section 402 is opposite head section 102. Legs 408 extend outwardly from hinges 106 and hinges 404. Legs 408 support chair 100 and a person reclining in chair 100. Further, head section 102 includes a light 420 which illuminates an area 422 below cavity 120. Light 420 may be removably attached to head section 102, or, alternatively, imbedded in cushion 202. Light 420 allows a person reclining in chair 100 and looking 120 to illuminate objects below cavity 120.

Chair 100 is a collapsible, lightweight chair in that it may be carried from one destination to another. Head section 102 and foot section 402 pivot on hinges 106 and 404, respectively, so that chair 100 is folded up to be comfortably carried by hand. This allows chair 100 to be portable and not fixed to a particular location. Thus, chair 100 is suitable for recreational use in the outdoors or at the beach. Also, straps 112 are durable and weather resistent. Further, straps 112 may be water resistent. Pads 410 may be attached to middle section 104, or foot section 402 to provide additional comfort to a reclining individual. Pads 410 are placed on top of straps 134. The location of pads 410 may vary as desired, or, alternatively, may be fixed to straps 134. Alternatively, pads 410 may be underneath straps 134 and attached to the frames of middle section 104 and foot section 402. The pads 410 are adjustable to slide within sections 104 and 402.

In another embodiment, chair 100 is floatable. Straps 112 are cushions able to float in water, or may be filled with air. Thus, a reclining person places their head on cushion 202, and looks through cavity 120 in water, such as a pool. Again, chair 100 is lightweight and portable.

FIG. 5 depicts another embodiment of chair 100 in accordance with the present invention. Chair 100 includes head section 502 and middle section 504. Head section 502 and middle section 504 are comprised of wood, metal, or any dense material heavier than the frames described in FIGS. 1–4. Head section 502 is heavier than head section 102 as described above. Chair 100 in this embodiment is not portable, and does not collapse to be carried. Joint 510 pivotally attaches head section 502 to middle section 504. Head section 502 may be detached from middle section 504. Joints 510 may be locked in place such that head section 502 does not pivot in relation to middle section 504. Head section 502 includes straps 506 that are horizontally wrapped around head section 502. Cushion 202 is attached to mounts 122 and 124. Mounts 122 and 124 are secured to straps 506. Straps 508 may be made of material similar to straps 506 and horizontally wrapped around middle section 504. Straps 506 and 508 may be comprised of sturdier material than straps 112 described in FIGS. 1 and 2. These materials may include plastic, fiber, cloth, rope or any other material known to one in the art suitable for supporting a person reclining on chair 100.

Other embodiments and uses of the invention will be apparent to those skilled in the art from consideration of the specification, and practice of the invention disclosed herein. All U.S. patents and patent applications, including provisional applications, and all other documents referenced herein, for whatever reason, are specifically incorporated by reference. It is intended that the specification and examples be considered exemplary only, with the true scope and spirit of the invention indicated by the following claims.

What is claimed is:

1. A portable recreational chair, comprising:

a plurality of sections, including a head section, wherein the body of a reclining individual is supported by said sections;

a cavity in said head section, said cavity substantially oval in shape and through said head section; and a facial support device in said head section and placed in said cavity, said facial support device comprising a moldable cushion and a mount attaching said cushion to said head section, and said moldable cushion surrounding and attached to said mount, such that the face of said reclining individual is placed into said facial support device and through said head section.

2. The chair of claim 1, wherein said facial device is removable from said head section.

3. The chair of claim 1, wherein said plurality of sections are pivotally attached to one another.

4. The chair of claim 1, wherein said cavity is an adjustable cavity, said adjustable cavity is adjusted to the size of the face of said reclining individual.

5. The chair of claim 1, wherein said head section further comprises an arm attached to said head section, said arm extends from said head section to be aligned with said facial support device.

6. The chair of claim 5, wherein said arm extends below said head section such that said reclining individual views items resting on said arm through said head section.

7. The chair of claim 1, further comprising a cover enveloping said moldable cushion.

8. The chair of claim 7, wherein said cover is removable from said moldable cushion.

9. The chair of claim 1, wherein said chair is collapsible into a compact shape for ease of transportation.

10. The chair of claim 9 wherein said plurality of sections further includes a middle section pivotally attached to said head section, said middle section parallels the surface on which said chair is placed and said head section rotates at angles to said middle section.

11. The chair of claim 10, wherein said plurality of sections further includes a leg section pivotally attached to said middle section that supports the legs of said reclining individual.

12. The chair of claim 11, further comprising pads removably attached to said sections.

13. The chair of claim 11, further comprising pads within said sections.

14. A portable recreational chair, comprising:

a plurality of sections, including a head section, wherein the body of a reclining individual is supported by said sections;

a cavity in said head section, said cavity substantially oval in shape and through said head section;

a facial support device in said head section and placed in said cavity, said facial support device comprising a moldable cushion and a mount attaching said cushion to said head section, and said moldable cushion surrounding and attached to said mount, such that the face of said reclining individual is placed into said facial support device and through said head section; and a light attached to said facial support device, wherein said light illuminates an area beneath said cavity.

15. A portable recreational chair, comprising:

a plurality of sections, including a head section, wherein the body of a reclining individual is supported by said sections;

a cavity in said head section, said cavity substantially oval in shape and through said head section; and a facial support device in said head section and placed in said cavity, said facial support device comprising a moldable cushion and a mount attaching said cushion to said head section, and said moldable cushion surrounding and attached to said mount, such that the face of said reclining individual is placed into said facial support device and through said head section, wherein said mount comprises a first and second border such that said first border is attached to a top side of said head section, and said second border is attached to a bottom side of said head section, opposite said first border.

16. The chair of claim 1, wherein said chair is floatable.

17. The chair of claim 1, wherein said moldable cushion is inflatable.

18. The chair of claim 1, wherein said chair is lightweight, such that said chair weighs about 4 kilograms.

19. A collapsible recreational use chair for supporting the body of a reclining individual, comprising:

a head section;

a middle section pivotally attached to said head section, wherein said head section rotates at angles to said middle section;

a leg section pivotally attached to said middle section opposite said head section that supports the legs of said reclining individual;

an oval cavity in said head section, wherein said cavity is about the size of the head of said reclining individual; and a facial support device in said head section and placed in said cavity, said facial support device comprising a moldable cushion and a mount attaching said cushion to said head section, said moldable cushion surrounding and attached to said mount, and a cover enveloping said moldable cushion, wherein the face of said reclining individual is placed into said facial support device and through said head section.

* * * * *